US005400468A

United States Patent [19]

De Petra

[11] Patent Number: 5,400,468

[45] Date of Patent: Mar. 28, 1995

[54] SLAT CLEANING APPARATUS

[76] Inventor: Andy De Petra, P.O. Box 626, Fremantle 6160, Australia

[21] Appl. No.: 966,842

[22] Filed: Oct. 27, 1992

[51] Int. Cl.[6] ..... A46B 13/04

[52] U.S. Cl. ..... 15/394; 15/321; 15/344; 15/24

[58] Field of Search ..... 15/322, 321, 394, 344, 15/400, 320, 302, 23, 24, 28

[56] References Cited

U.S. PATENT DOCUMENTS

| | | | |
|---|---|---|---|
| 1,237,047 | 8/1917 | Howell | 15/394 |
| 2,246,036 | 6/1941 | Farrell | 15/394 |
| 2,615,192 | 10/1952 | Morell | 15/394 |
| 2,682,676 | 7/1954 | Franchi | 15/302 |
| 3,027,585 | 4/1962 | Freedman et al. | 15/28 |
| 3,425,087 | 2/1969 | Fitzhugh | 15/28 |
| 3,892,004 | 7/1975 | Downes | 15/24 |
| 3,939,527 | 2/1976 | Jones | 15/321 |
| 4,512,053 | 4/1985 | Horak et al. | 15/28 |
| 4,538,315 | 9/1985 | Barth | 15/24 |
| 4,591,390 | 5/1986 | Scott et al. | 15/302 |

*Primary Examiner*—Timothy F. Simone
*Assistant Examiner*—Reginald L. Alexander
*Attorney, Agent, or Firm*—Larson and Taylor

[57] ABSTRACT

A slat cleaning apparatus (10) is disclosed for use in cleaning slats making up a verticle blind. Cleaning of vertical blind slats is made complicated by the difference in thickness of the head, body and tail of the slat and by the needs to apply and remove a cleaning liquid without creating mess to surrounding slats and or windows. The slat cleaning apparatus has a head (16) with a slot (70) and a partable barrier located in the slot (70) for substantially sealing against the slat. A fluid extractor (50,74) is provided for operating under vacuum pressure to withdraw fluid and entrained matter from the head (16). Two cleaning elements (72) are provided substantially mutually parallel and located on opposite sides of the slot (70) for cleaning the slat. The cleaning elements (72) are compressible or moveable for operating at differing gaps to accommodate the differing thickness in the slats. An injector button (18) is provided for rapidly disengaging the cleaning elements (72) from a drive unit (12) of the apparatus (10) should it be necessary to rapidly cease actuation of the cleaning elements (72), such as, for example in the event that a thread of the slat becomes entangled with the cleaning elements (72). The head (16) is substantially transparent to enable viewing of the function of the cleaning elements (72) and removal of the fluid and entrained matter when in use. The drive units (12) may be of conventual type and the fluid extractor (50,74) may be coupled to a conventional source of vacuum.

10 Claims, 3 Drawing Sheets

SLAT CLEANING APPARATUS

The present invention relates to a slat cleaning apparatus particularly, although not exclusively, envisaged for use in cleaning textile slats used in vertical blinds.

It is known to provide cleaning apparatus for cleaning horizontally disposed venetian blinds. This is exemplified by the following U.S. Pat. Nos. 3,892,004, 4,787,118, 4,730,360, 4,756,050, 3,445,880, 4,277,861, 4,483,037, 4,435,874, 3,643,277, 3,520,018. Typically, such apparatus include two or more cleaning elements arranged side by side for receiving a single slat of the venetian blind between them. The cleaning elements may be stationary, reciprocable or rotatable for cleaning the two surfaces of the slat. However, such apparatus are not well suited to cleaning textile slats used in vertical blinds. The textile slats are generally rougher than venetian blind slats and so require cleaning with cleaning elements capable of contacting the textured surfaces of textile slats. This requires special consideration for the surfaces of the cleaning elements. Also, the textile slats have head and tail assemblies which are much thicker than the remainder of the slat which presents special problems for cleaning the slats thereat. With prior art blind cleaning apparatus the head and tail assemblies must be disassembled before cleaning and then reassembled, which adds considerably to the time and cost of cleaning the blinds. Furthermore, to properly clean textile slats a liquid cleaning agent must be applied to the slats and then removed again. Prior art cleaning apparatus of the hand held type have not addressed these problems.

Therefore, it is an object of the present invention to provide a slat cleaning apparatus capable of cleaning a textile slat in situ.

According to one aspect of the present invention there is provided a slat cleaning apparatus for cleaning blinds, the slat cleaning apparatus comprising a body adapted for attachment to a hand held drive unit; a head extending from the body, the head having a slot disposed vertically through it for receiving a first slat of the set of vertical blinds, the head being adapted for location between two further slats located adjacent the opposite sides of the said first slat, the head also having two cylindrical cleaning elements disposed substantially mutually parallel and located inside the head and astride the slot, the cleaning elements protruding into an area bounded by the slot for receiving the said first slat and simultaneously cleaning both sides of the first slat, the head further having a release mechanism for rapid disengagement of the cleaning elements from driving connection with the drive unit to allow rotation of the cleaning members to be stopped rapidly when the cleaning elements become entangled with a thread from the first slat, and the head further having a liquid application means disposed for applying a liquid cleaning agent onto the first slat within the head, the liquid application means including a flow control means for adjusting the rate of application of the cleaning agent onto the first slat to allow for differing cleaning requirements of differing fabrics from which the slats may be made; means for introducing the cleaning agent into the head; and, extraction means for removing air, cleaning agent which has not been absorbed by the first slat, cleaning agent which has not been absorbed by the cleaning elements and matter released from the surface of the first slat, from the head; whereby, in use, the slat cleaning apparatus can be moved along the length of the first slat for simultaneously cleaning both sides of the first slat with the cleaning elements.

According to another aspect of the present invention there is provided a slat cleaning apparatus for cleaning Typically, the depth of the slot through the head is small compared with the length of the slat.

Preferably, the cleaning elements are contra-rotating rollers. Preferably, the rollers are at least as long as the width of the slat. Typically, the rollers are covered with bristles and the rollers are in mutual contact in the vicinity of the slot. Preferably, the cleaning elements are compressible for accepting slats of differing thickness and for enabling cleaning of a head and tail of the slat, the head and tail conventionally being substantially thicker than the remainder of the slat.

Preferably, the slot is dimensioned for receiving the head and the tail of the slat. Preferably, the slot is at least as long as the width of the slat. Preferably, the slot has a partable barrier for sealing the head about the slat. Typically, the partable barrier is made from rows of bristles.

Preferably, the cleaning elements can be rapidly stopped from rotating. Advantageously, the cleaning elements are ejectable for disengagement with the drive unit for rapidly stopping rotation of the cleaning elements.

Preferably, the slat cleaning apparatus also includes or is adapted to be coupled to a supply of liquid cleaning agent. Typically, the liquid cleaning agent is supplied under pressure.

Preferably, spray means is located within the head for applying liquid cleaning agent onto the slat, either directly or indirectly. For example, the liquid cleaning agent may be applied to the cleaning elements and thereby to the slat.

Preferably, the head has a housing having the cleaning elements disposed in an upper part of the housing and a lower part of the housing for defining a recovery chamber. The recovery chamber constitutes part of the fluid extraction means.

Preferably, the housing is transparent for enabling an operator to view the cleaning elements when in operation.

Preferably, the drive unit is controllable to vary the speed of rotation of the cleaning elements. Typically, the speed is controllable between 0 and 2000 rpm.

The drive unit may be a conventional drive unit capable of rotating two parallel elements in opposite direction, such as, for example, a hand held food mixer.

The fluid extraction means may include a source of air vacuum coupled to the recovery chamber or, alternatively, the fluid extraction means may be adapted for coupling to the source of air vacuum. In the latter case the source of air vacuum may be a conventional source, such as, for example, a vacuum cleaner.

The present invention will hereinafter be described with particular reference to a slat cleaning apparatus incorporating a drive unit and for coupling to supplies of air vacuum and liquid cleaning agent.

One embodiment, being an example only, of the present invention will now be described with reference to the accompanying drawings in which.

Figure 1:
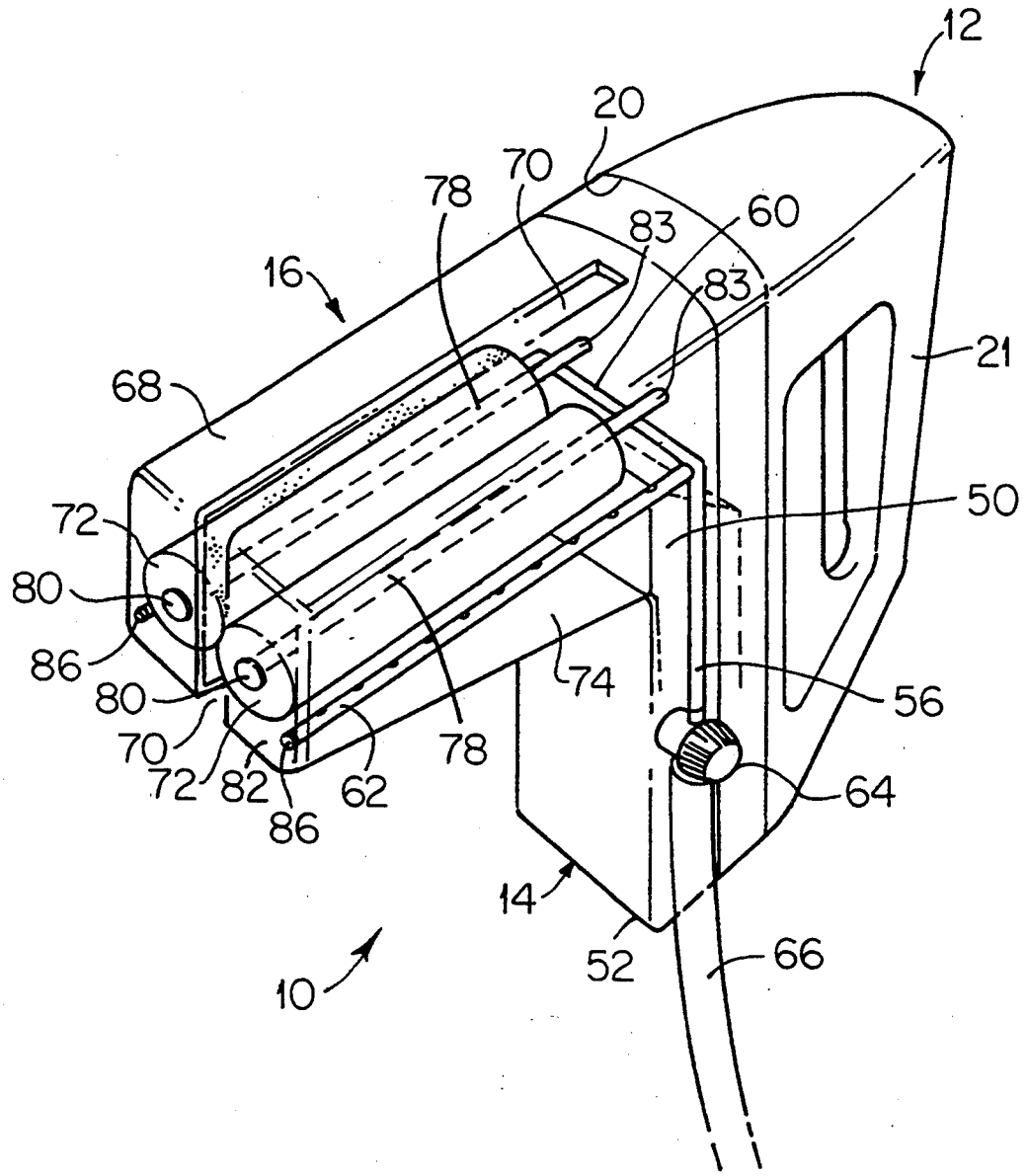
FIG. 1 is a perspective views, seen from above, of a slat cleaning apparatus shown incorporating a drive unit.

In FIG. 1 there is shown a slat cleaning apparatus 10 comprising a drive unit 12, a body 14 and a head 16.

The drive unit 12 has an electric motor, a gear box, two drive sockets and a release button. The gear box couples the electric motor to the drive sockets so as to enable contra-rotation of the drive sockets with respect to each other. A speed controller may be provided to vary the speed of rotation of the electric motor and hence the speed of rotation of the drive sockets. Typically, the speed of the motor can be controlled between 0 and 2000 rpm. The drive sockets are spaced apart laterally on a front face 20 of the drive unit 12. The release button, according to the present embodiment, operates for retracting the drive sockets away from the front face 20.

The drive unit 12 also has a hand grip 21 for facilitating hand operation of the slat cleaning apparatus 10.

Conveniently the drive unit 12 can be a conventional hand held mixer, such as, for example a food mixer sold under the Registered Trade Mark BLACK & DECKER.

Figure 2:
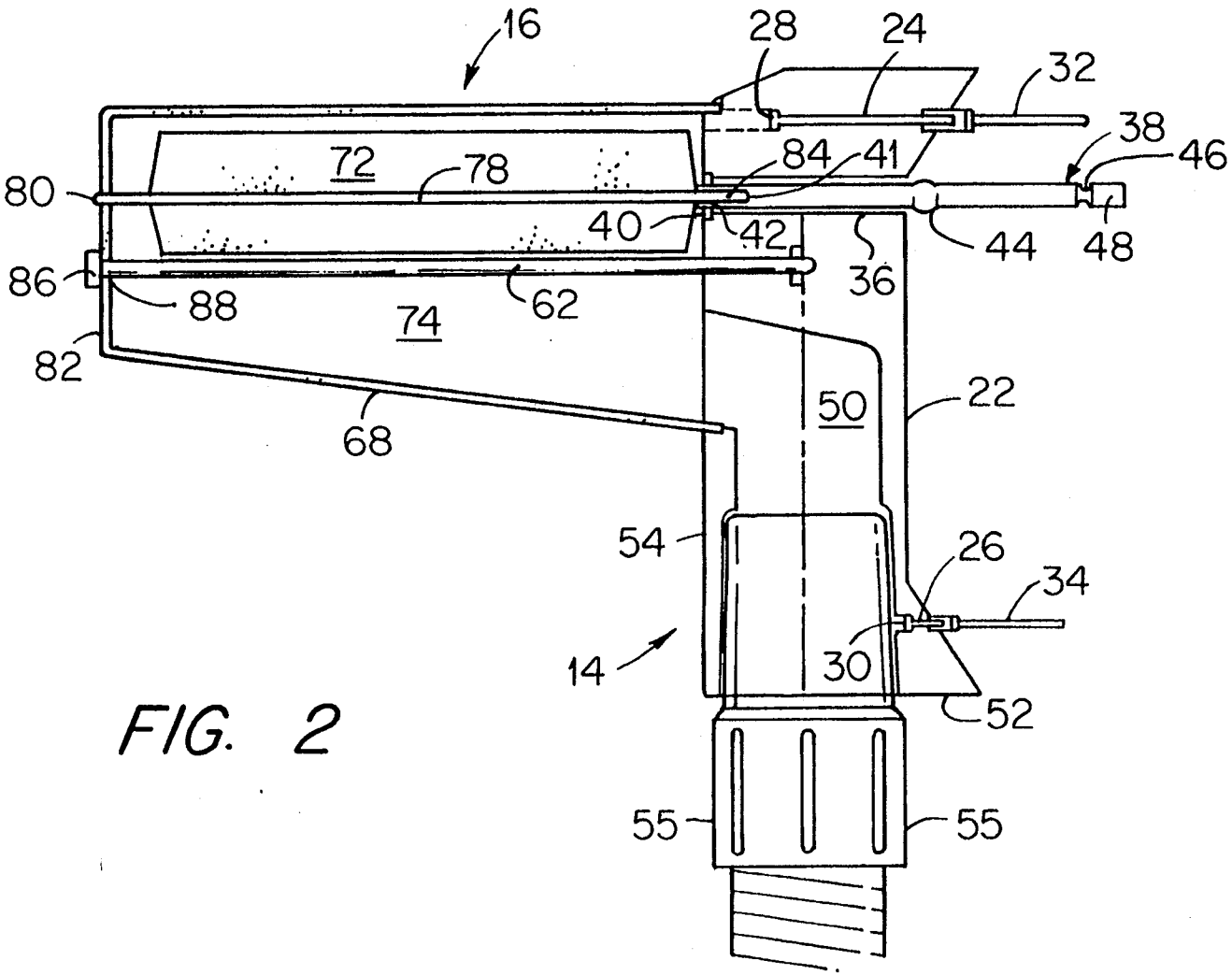
FIG. 2 is a cross-sectional side view of the apparatus of FIG. 1.

As shown in FIG. 2 the body 14 has a rear face 22 adapted to match the front face 20 of the drive unit 12. Two holes 24 and 26 extend through the body 14 and emerge at the rear face 22. The holes 24 and 26 receive respective bolts 28 and 30 having threaded ends 32 and 34. The bolts 28 and 30 can be threaded into corresponding threaded holes in the drive unit 12 for securing the body 14 onto the drive unit 12. The body 14 has two further holes 36, only one of which is shown in FIG. 2. The holes 36 each receive a drive shaft 38 which is rotatably retained in a bush 40 located at an end 42 of the respective holes 36 remote from the drive unit 12. Each drive shaft 38 has a recess 41 at end 42, a bulb 44 located intermediate the length of the drive shaft 38, and an annular groove 46 located proximate an end 48 of the drive shaft 38 remote from end 42. The bulbs 44 inhibit movement of the drive shafts 38 axially in the holes 36. The annular grooves 46 couple the drive shafts 38 into respective ones of the drive sockets of drive unit 12.

Figure 3:
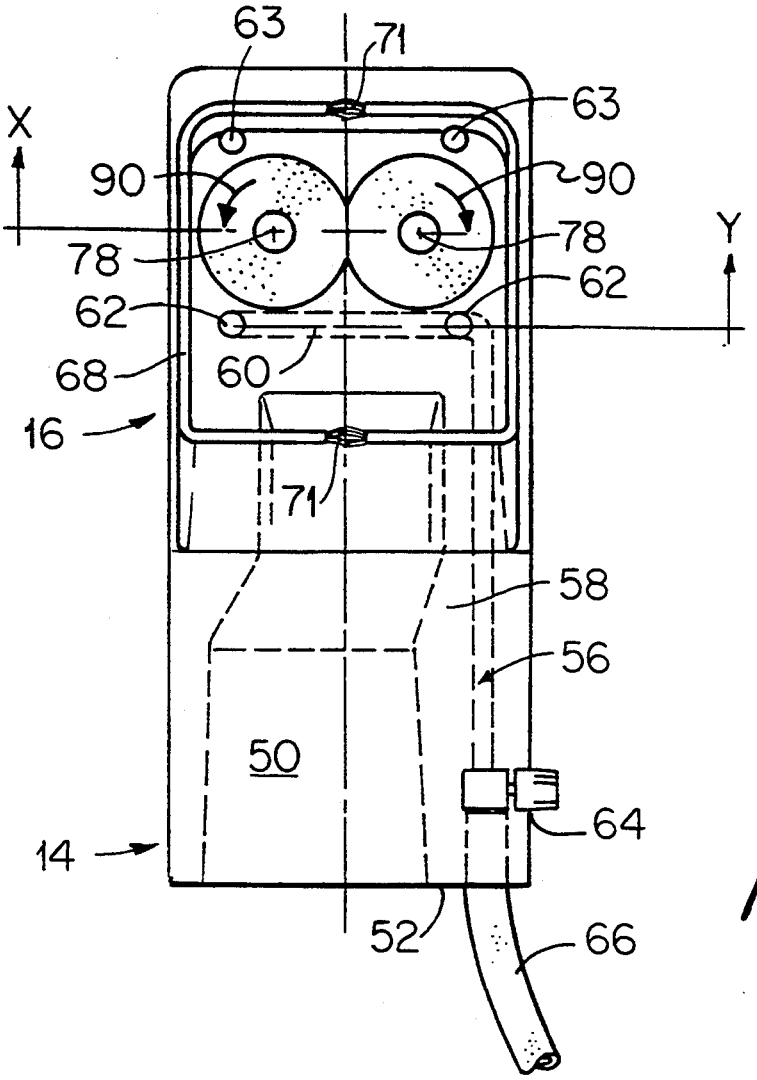
FIG. 3 is a cross-sectional end view of the slat cleaning apparatus of FIGS. 1 and 2 shown with the drive unit detached; and, FIG. 4 is a cross-sectional plan view of the slat cleaning apparatus of FIG. 3, taken on line X-Y.
Figure 4:
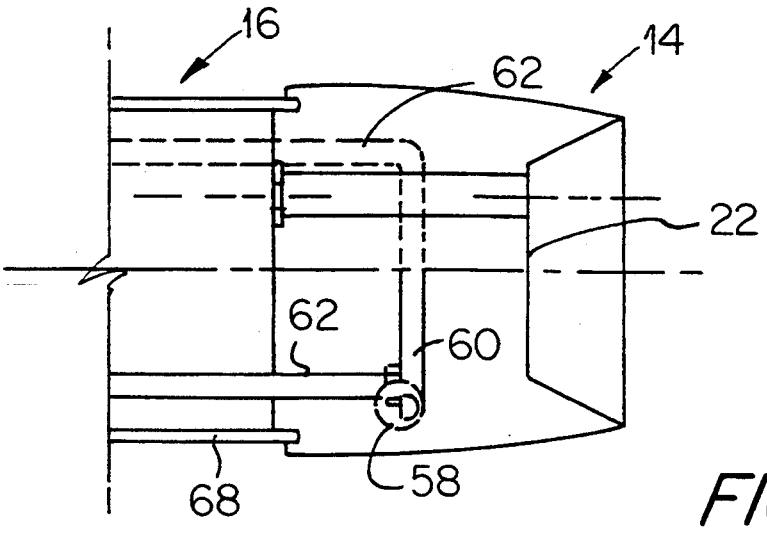

The body 14 also has a duct 50 extending between a lower end 52 of the body 14 and a front face 54 of the body 14. The duct 50 carries fluid from the front face 54 to the lower end 52. At the lower end 52 the duct 50 receives a vacuum hose 55 which, in the exemplary embodiment is connected to a conventional vacuum cleaner. As shown in FIGS. 3 and 4, the body 14 further has a conduit 56 formed of a riser 58, a connector piece 60 and two spray ducts 62, which form the liquid application means of the present invention. The spray ducts 62 are formed integrally in the body 14. The riser 58 extends from a valve 64 proximate the lower end 52 to the connector piece 60. The connector piece 60 couples the two spray ducts 62 to the riser 58. The spray ducts 62 extend into the head 16 and are typically formed of stainless steel and have holes drilled along their length at regular spaced intervals to act as liquid spray jets. The valve 64 is connected to a liquid supply tube 66.

The head 16 is attached to the front face 54 of body 14 and has a housing 68 having a slot 70 (see FIG. 1) arranged substantially vertically through it. The slot 70 effectively splits the housing 68 into two similarly shaped parts. The slot 70 is wide enough to receive a slat for cleaning. More preferably, the slot 70 is capable of receiving the head, the tail and the body of the slat. Preferably, the slot 70 has a partable barrier 71 (see FIG. 3) for sealing the head 16 about the slat. Typically, partable barrier 71 is made of rows of bristles depending towards each other from the two sides of the slot 70. Two cleaning elements 72 are located in an upper part of the housing 68. The cleaning elements 72 are disposed parallel to and astride the slot 70. A lower part of the housing 68 defines a recovery chamber 74 which communicates with the duct 50 at the front face 54 of the body 14. The recovery chamber 74 is preferably located below the cleaning elements 72 so that excess liquid and dirt can fall under the force of gravity into the recovery chamber 74 thus assisting in removal of the dirt and liquid from the head 16. In the exemplary embodiment the cleaning elements 72 are substantially cylindrical rollers covered with bristles. The rollers each have an axle 78. Each axle 78 is rotatably mounted at an end 80 in a front face 82 of the housing 68. Another end 84 of each axle 78 is secured to a respective one of the drive shafts 38 for rotation therewith.

The spray ducts 62 terminate at the front face 82 of the housing 68 in caps 86 locatable in holes 88 in the front face 82. The caps 86 seal off the spray ducts 62 and can be removed therefrom for allowing removal of the housing 68 from body 14. The holes in the spray ducts 62 are directed towards the cleaning elements 72, particularly as shown in FIG. 3.

In the exemplary embodiment the housing 68 also has two further spray tubes 63 (see FIG. 3) with holes directed downwardly towards the cleaning elements 72. The further spray tubes 84 are also connected to the riser 58.

Preferably, the housing 68 is transparent for allowing observation of the operation of the cleaning elements 72, the rate of spray of liquid and the amount of liquid collecting in the housing 68 so that the valve 64 may be adjusted to enable sufficient wetting of the slat and to limit the amount of slat cleaning fluid to be removed from the housing 68.

In use, the slat cleaning apparatus 10 of the exemplary embodiment, is assembled by coupling the ends 48 of the drive shaft 38 into respective ones of the drive sockets of the drive unit 12. The other ends 42 of the shafts 38 are then inserted into the holes 36 of the body 14 and the body 14 is moved towards the drive unit 12 until the rear face 22 of the body 14 meets the front face 20 of the drive unit 12 and the drive shafts 38 become journalled in bushes 40. The threaded ends 32 and 34 of the bolts 28 and 30 are then threaded into the drive unit 12 for securing the body 14 to the drive unit 12. The ends 84 of the cleaning element 72 are then inserted into the recesses 41 in the ends 42 of the drive shafts 38. The housing 68 is then placed axially over the cleaning elements 72 until the housing 68 meets the body 14 and the spray ducts 62 terminate in the holes 88. The caps 86 are then secured in the holes 88 and onto the ends of the spray ducts 62 to seal them off.

The duct 50 is then connected to the vacuum hose 55 and the valve 64 is connected to the liquid supply tube 66. The vacuum hose 55 is connected to a source of air vacuum, such as, for example, a conventional wet type vacuum cleaner, and the liquid supply tube 66 is connected to a source of cleaning liquid maintained under pressure. The valve 64 is adjusted to control the rate of spray of the cleaning fluid onto the cleaning elements 72. The drive unit 12 is then adjusted to control the rate of rotation of the cleaning elements 72. Variation of the rate of cleaning fluid flow and the rate of rotation will depend upon the nature of the vertical slats to be cleaned.

A cleaning operation for a vertical slat is conducted as follows. An operator of the slat cleaning apparatus 10 grips the hand grip 21 of the drive unit 12 and directs the head 16 so that the slot 70 receives one of the slats. The two parts of the housing 68 are thus disposed between said slat and two slats adjacent the sides of said slat. By such location the bristles of the cleaning element 72 contact the sides of the slat and the bristles of portable barrier 71 in the slot 70 substantially seal the housing 68 about the slat. Rotation of the cleaning elements 72 then brushes dirt and the like from the surface of the slat. Spray of cleaning fluid from the spray ducts 62 and 63 coats the bristles of the cleaning elements 72 with the cleaning fluid, and rotation of the cleaning elements 72 thus applies the cleaning fluid onto the surface of the slats. The operator may view the cleaning of the slat through the transparent housing 68 and adjust the valve 64 and the speed of rotation of the cleaning elements 72 to effect efficient cleaning. Typically, the head 16 is first inserted at a head of the slats and moved down the slat towards the tail of the slat. In the exemplary embodiment the cleaning elements 72 rotate in opposite directions as shown by the arrows 90 in FIG. 3. By this rotation the slat cleaning apparatus 10 tends to pull the slats upwardly through the slot 70. In order to resist this the operator grips the tail of the slat and provides an upward force against the slat cleaning apparatus 10 so as to control the rate of descent of the slat cleaning apparatus down the slat.

As the cleaning operation proceeds, the liquid lubricant and the dirt and the like collect in the recovery chamber 74 and are removed therefrom by the air suction applied by the vacuum hose 55. Once the cleaning operation has progressed to the tail of the slat, the head 16 may be removed from the slat and located upon the head of the next slat to be cleaned.

It can be seen from the above that slat cleaning apparatus 10 of the present invention is capable of cleaning virtually the entire slat from the relatively thick head of the slat through the relatively thin body of the slat to the relatively thick tail of the slat. The design of the head 16 allows for cleaning of the tail of the slat without removal of the weights or the chains from the tail of the slat—thus increasing the ease of cleaning of an entire vertical blind. The rotational direction of the cleaning elements 72 assists in propelling the slat cleaning apparatus 10 along the length of the slat, which thereby reduces the amount of effort required in moving the slat cleaning apparatus 10 and increases the speed at which slats can be cleaned. The location of the recovery chamber 74 provides for efficient removal of fluid, including entrained dirt and the like, from the housing 68. The release button allows for rapid detachment of the cleaning elements 72 from the drive unit 12 and hence enables rapid stopping of the cleaning elements 72 in the event that the cleaning elements 72 become tangled with a thread of the slat. The transparent nature of the housing 68 enables the operator to view the rotating elements 72 and the collection of the fluid and entrained dirt and the like therefrom so as to readily monitor the adequacy of the speed of rotation of the cleaning elements 72 and the supply of cleaning fluid. Ready adjustments of these rates is also provided for. Removal of the housing 68 is provided for, to allow for easy removal of the cleaning elements 72 for replacement by cleaning elements of a differing construction for use in cleaning slats having differing texture. For example, slats having a relatively course texture typically require cleaning elements 72 having bristles, whereas slats of a relatively smooth texture typically require cleaning elements 72 having felt coverings or similar soft coverings.

Modifications and variations such as would be apparent to a skilled addressee are deemed within the scope of the present invention. For example, the cleaning elements 72 could be flat pads disposed facing each other and driven in an orbital manner (as in an orbital sander) in opposite directions. Also, the cleaning elements 72 may be spring biased towards the slat for accommodating the variations in thickness of the slat whilst not requiring the cleaning elements 72 to be compressible.

What I claimed is:

1. A slat cleaning apparatus for cleaning flexible elongate slats made from fabric, the slats being located in situ in a set of vertical blinds, the slat cleaning apparatus comprising:

a body adapted for attachment to a hand held drive unit;

a head extending from the body, the head having a slot disposed vertically through it for receiving a first slat of the set of vertical blinds, the head being adapted for location between two further slats located adjacent the opposite sides of the said first slat, the head also having two cylindrical cleaning elements disposed substantially mutually parallel and located inside the head and astride the slot, the cleaning elements protruding into an area bounded by the slot for receiving the said first slat and simultaneously cleaning both sides of the first slat, the head further having a release mechanism for rapid disengagement of the cleaning elements from driving connection with the drive unit to allow rotation of the cleaning members to be stopped rapidly when the cleaning elements become entangled with a thread from the first slat, and the head further having a liquid application means disposed for applying a liquid cleaning agent onto the first slat within the head, the liquid application means including a flow control means for adjusting the rate of application of the cleaning agent onto the first slat to allow for differing cleaning requirements of differing fabrics from which the slats may be made;

means for introducing the cleaning agent into the head; and, extraction means for removing air, cleaning agent which has not been absorbed by the first slat, cleaning agent which has not been absorbed by the cleaning elements and matter released from the surface of the first slat, from the head;

whereby, in use, the slat cleaning apparatus can be moved along the length of the first slat for simultaneously cleaning both sides of the first slat with the cleaning elements.

2. A slat cleaning apparatus for cleaning flexible elongate slats made from fabric, the slats being located in situ in a set of vertical blinds, the slat cleaning apparatus comprising:

a drive unit adapted to be hand held;

a body attached to the drive unit;

a head extending from the body, the head having a slot disposed vertically through it for receiving a first slat of the set of vertical blinds, the head being adapted for location between two further slats located adjacent the opposite sides of said first slat, the head also having two cylindrical cleaning elements disposed substantially mutually parallel and located inside the head and astride the slot, the cleaning elements protruding into an area bounded by the slot for receiving the said first slat and simultaneously cleaning both sides of the first slat, the head further having a release mechanism for rapid disengagement of the cleaning elements from driving connection with the drive unit to allow rotation of the cleaning members to be stopped rapidly when the cleaning elements become entangled with a thread from the first slat, and the head further having a liquid application means disposed for applying a liquid cleaning agent onto the first slat within the head, the liquid application means including a flow control means for adjusting the rate of application of the cleaning agent onto the first slat to allow for differing cleaning requirements of differing fabrics from which the slats may be made;

means for introducing the cleaning agent into the head; and, extraction means for removing air, cleaning agent which has not been absorbed by the first slat, cleaning agent which has not been absorbed by the cleaning elements and matter released from the surface of the first slat, from the head;

whereby, in use, the slat cleaning apparatus can be moved along the length of the first slat for simultaneously cleaning both sides of the first slat with the cleaning elements.

3. A slat cleaning apparatus according to claim 2, also having a liquid application means disposed for applying liquid cleaning agent onto the slat within the head.

4. A slat cleaning apparatus according to claim 2, in which the liquid application means applies the liquid cleaning agent directly onto the first slat.

5. A slat cleaning apparatus according to claim 2, in which the liquid application means applies the liquid cleaning agent onto the outer surface of the cleaning elements and thereby onto the first slat.

6. A slat cleaning apparatus according to claim 1, in which the slat is dimensioned to receive a head, a tail and body of the first slat and in which the cleaning elements can be compressed by the head and the tail to allow passage of the head and the tail of the first slat completely through the head of the slat cleaning apparatus.

7. A slat cleaning apparatus according to claim 5, in which the slot is provided with a barrier which is partable by the first slat for allowing the slot to be located about and removed from about the first slat, the partable barrier substantially sealing the head to the slat for inhibiting egress of the cleaning agent from the head through the slot.

8. A slat cleaning apparatus according to claim 2, in which the head has a housing with the cleaning elements disposed in an upper part thereof and a recovery chamber defined below the cleaning elements whereby, in use, cleaning of the first slat takes place in the upper part of the housing and removal of the cleaning agent and matter released from the surface of the first slat occurs from the recovery chamber.

9. A slat cleaning apparatus according to claim 2, in which the housing is substantially transparent for enabling viewing of the operation of the cleaning elements and removal of the cleaning agent and the matter released from the surface of the first slat, when in use, to allow adjustment of the rate of application of the cleaning agent with the flow control means to allow for the differing cleaning requirements of differing fabrics from which the slats may be made.

10. A slat cleaning apparatus according to claim 2, further comprising control means for controlling the speed of rotation of the cleaning elements.

* * * * *